US007841685B2

(12) United States Patent
Ito

(10) Patent No.: US 7,841,685 B2
(45) Date of Patent: Nov. 30, 2010

(54) PRINTING APPARATUS AND DRIVER IC HAVING A DUMMY DRIVE CIRCUIT

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 517 days.

(21) Appl. No.: 11/768,900

(22) Filed: Jun. 26, 2007

(65) Prior Publication Data

US 2007/0296753 A1 Dec. 27, 2007

(30) Foreign Application Priority Data

Jun. 27, 2006 (JP) ..... 2006-176415

(51) Int. Cl.
*B41J 29/393* (2006.01)
*B41J 2/45* (2006.01)
*B41J 29/38* (2006.01)

(52) U.S. Cl. ..... 347/19; 347/9; 347/68

(58) Field of Classification Search ..... 347/19
See application file for complete search history.

(56) References Cited

U.S. PATENT DOCUMENTS

| | | | | |
|---|---|---|---|---|
| 5,633,671 | A | 5/1997 | Watanabe | |
| 6,382,756 | B1 | 5/2002 | Komuro | |
| 6,523,922 | B2 | 2/2003 | Hirayama | |
| 6,582,045 | B2 * | 6/2003 | Hirayama | 347/14 |
| 7,175,248 | B2 * | 2/2007 | Wade | 347/19 |
| 2001/0033305 | A1 * | 10/2001 | Tamura | 347/19 |

FOREIGN PATENT DOCUMENTS

| | | | | |
|---|---|---|---|---|
| JP | H02-212164 | A | | 8/1990 |
| JP | H03-208654 | A | | 9/1991 |
| JP | H10-95116 | A | | 4/1998 |
| JP | 2000280467 | A | | 10/2000 |
| JP | 2001277516 | A | | 10/2001 |
| JP | 2002059543 | A | | 2/2002 |
| JP | 2002205395 | A | | 7/2002 |
| JP | 2004237523 | A | * | 8/2004 |

OTHER PUBLICATIONS

English machine translation of JP 2002059543 A to Tamura, translation performed on Nov. 5, 2009 via http://www.ipdl.inpit.go.jp/homepg_e.ipdl.*
Machine translation of the written description of Japanese patent document 2002-205395, acquired via http://www.ipdl.inpit.go.jp/homepg_e.ipdl on Mar. 31, 2010.*
Chinese Office Action issued in corresponding Chinese Application No. 2006-176415, dated Apr. 22, 2008.

* cited by examiner

*Primary Examiner*—Matthew Luu
*Assistant Examiner*—Shelby Fidler
(74) *Attorney, Agent, or Firm*—Baker Botts L.L.P.

(57) ABSTRACT

A printing apparatus includes a recording head, a driver IC, a dummy signal detection circuit, and a drive signal control circuit. The recording head has a recording element which performs recording on a recording medium. The driver IC has a drive circuit which applies a drive signal to the recording element, and a dummy drive circuit which outputs a dummy signal having a value associated with the drive signal. The dummy signal detection circuit detects the dummy signal. The drive signal control circuit controls the drive signal based on a value of the dummy signal detected by the dummy signal detection circuit.

10 Claims, 12 Drawing Sheets

PRINTING APPARATUS AND DRIVER IC HAVING A DUMMY DRIVE CIRCUIT

BACKGROUND OF THE INVENTION

1. Field of the Invention

The present invention relates to a printing apparatus which performs recording on a recording medium, and also relates to a driver IC.

2. Description of the Related Art

In some printing apparatuses which perform recording on recording media, a drive signal for driving a recording head is controlled in order to stabilize recording characteristics. According to an ink-jet head driver disclosed in Japanese Unexamined Patent Publication No. 2002-205395, at a time of manufacturing an ink-jet head which is a recording head, the ink-jet head is assigned to one of a plurality of ranks. An initial value of a pulse width of a pulse signal, which will be applied to a driver IC to drive the ink-jet head, is determined in accordance with the rank. In addition, during a printing operation, a temperature detection circuit provided away from the driver IC detects an ambient temperature of the ink-jet head. The initial value of the pulse width is corrected based on the ambient temperature detected, and thus an actual pulse signal is obtained. Thereby, unstableness of ejection characteristics of ink ejected from the ink-jet head, that is, unstableness of recording characteristics, can be prevented.

SUMMARY OF THE INVENTION

When a driver IC is driven, a temperature of the driver IC itself increases. Temperature increase of the driver IC causes a change in electrical characteristics of a drive circuit which is included in the driver IC. Here, a temperature of the driver IC and an ambient temperature are not always the same. According to the disclosure of the above-mentioned document, no compensation is made for a change in temperature of the driver IC, and therefore ink ejection characteristics may undesirably become unstable.

In addition, when a plurality of driver ICs are provided in a single printing apparatus, there are a plurality of drive circuits which are included in the driver ICs. In such a case, if electrical characteristics of the respective drive circuits greatly differ among the driver ICs, a form of a drive signal needs to be changed in accordance with which driver IC the drive signal will be supplied, in order to suppress variation in recording characteristics among different driver ICs. This makes a circuit configuration complicated. Electrical characteristics of a drive circuit included in a driver IC can be checked by fixing the driver IC to a printing apparatus and performing recording on a recording medium. However, once a driver IC is fixed to a printing apparatus, it is troublesome to remove the driver IC from the printing apparatus and then fix the driver IC to another printing apparatus again.

The present invention may provide a printing apparatus which can present stable recording characteristics even when a temperature of a driver IC changes.

The present invention may also provide a driver IC which allows electrical characteristics of a drive circuit to be easily checked without mounting the driver IC to a printing apparatus.

According to an aspect of the present invention, there is provided a printing apparatus including a recording head, a driver IC, a dummy signal detection circuit, and a drive signal control circuit. The recording head includes a recording element which performs recording on a recording medium. The driver IC includes a drive circuit which applies a drive signal to the recording element, and a dummy drive circuit which outputs a dummy signal having a value associated with the drive signal. The dummy signal detection circuit detects the dummy signal. The drive signal control circuit controls the drive signal based on a value of the dummy signal detected by the dummy signal detection circuit.

According to the aspect, the dummy signal outputted from the dummy drive circuit has a value associated with the drive signal, and the drive signal which is applied by the drive circuit to the recording element is controlled based on a value of the dummy signal which takes account of change in electrical characteristics of the drive circuit involved in change in temperature of the driver IC. Therefore, even if electrical characteristics of the drive circuit are changed by change in temperature of the driver IC, recording characteristics of the printing apparatus are stabilized.

According to another aspect of the present invention, there is provided a driver IC which drives a recording element which performs recording on a recording medium. The driver IC includes a drive circuit and a dummy drive circuit. The drive circuit applies a drive signal to the recording element. The dummy drive circuit outputs a dummy signal having a value associated with the drive signal. Each of the drive circuit and the dummy drive circuit includes a first terminal, a second terminal, and a third terminal. The drive circuit is able to selectively take either one of a charge state where the third terminal is connected to the first terminal but not connected to the second terminal and a discharge state where the third terminal is connected to the second terminal but not connected to the first terminal. The dummy drive circuit is always kept in either one of the charge state and the discharge state.

According to the aspect, the dummy signal outputted from the dummy drive circuit has a value associated with the drive signal. Therefore, electrical characteristics of the drive circuit can be easily checked without mounting the driver IC to a printing apparatus. This makes it possible to assemble a plurality of driver ICs whose drive circuits do not greatly differ in electrical characteristics in order to manufacture a printing apparatus. Besides, since the dummy drive circuit is always kept in either one of the charge state and the discharge state, it is not necessary to apply a control signal to the dummy drive circuit to bring it into the charge or discharge state.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
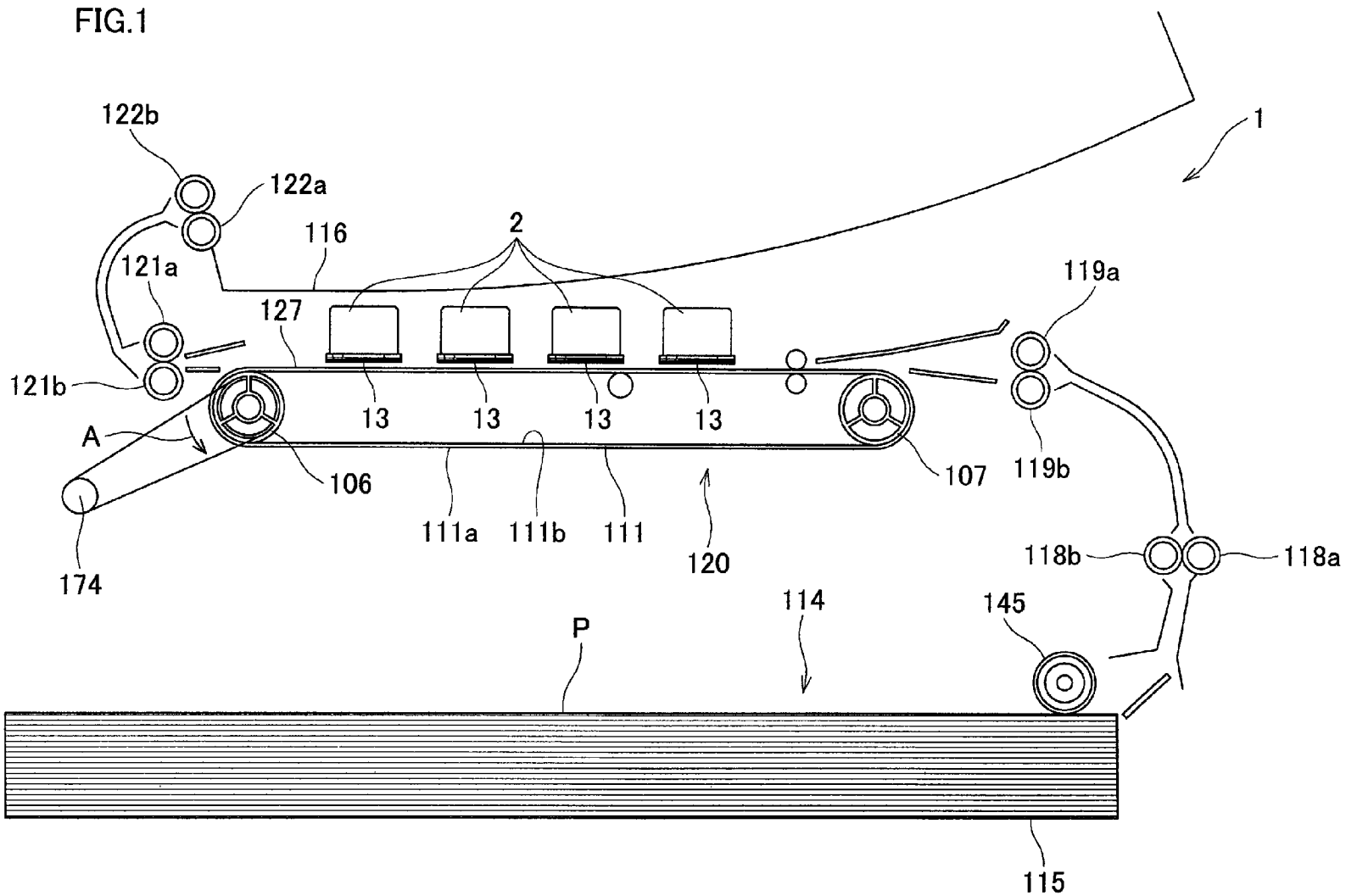
FIG. 1 illustrates a schematic construction of a printer according to one embodiment of the present invention.

A printer 1 shown in FIG. 1 is a color ink-jet printer of line-head type, including for immovable ink-jet heads 2. The ink-jet head 2 is elongated in a direction perpendicularly crossing the drawing sheet of FIG. 1, and has a rectangular shape in a plan view. A paper feed unit 114, a paper receiving unit 116, and a conveyor unit 120 are provided in lower, upper, and middle parts of the printer 1, respectively.

The paper feed unit 114 has a paper holder 115 and a paper-feed roller 145. The paper holder 115 is able to hold a stack of rectangular printing papers P. The paper-feed roller 145 sends the uppermost one of the printing papers P held in the paper holder 115, out toward the conveyor unit 120. The paper holder 115 holds a printing paper P in such a manner that the printing paper P is sent out in a direction parallel to its longer side. Between the paper holder 115 and the conveyor unit 120, two pairs of feed rollers 118*a* and 118*b*, and 119*a* and 119*b* are disposed along a conveyance path.

The conveyor unit 120 has an endless conveyor belt 111, and two belt rollers 106 and 107 on which the conveyor belt 11 is wound. The conveyor belt 111, which is wound on the two belt rollers 106 and 107, defines two parallel planes each including a tangent line which is common to the belt rollers 106 and 107. Of these two planes, the one opposed to the ink-jet heads 2 forms a conveyor face 127 for the printing paper P. A printing paper P sent out of the paper feed unit 114 is conveyed on the conveyor face 127, while the ink-jet heads 2 is performing printing on an upper face of the printing paper P. Then, the printing paper P reaches the paper receiving unit 116. A plurality of printing papers P thus printed are piled in the paper receiving unit 116.

The four ink-jet heads 2 eject magenta ink (M), yellow ink (Y), cyan ink (C), and black ink (K), respectively, from a plurality of ejection ports 8 (see FIG. 5) formed on bottom faces thereof. A narrow gap is formed between the bottom faces of the ink-jet heads 2 and the conveyor face 127 of the conveyor belt 111. A conveyance path is formed through the gap, and a printing paper P is conveyed along the conveyance path from right to left in FIG. 1. While the printing paper P sequentially passes under the four ink-jet heads 2, ink is ejected from the ejection ports 8 toward an upper face of the printing paper P in accordance with image data, so that a desired color image is formed on the printing paper P.

The two belt rollers 106 and 107 are in contact with an inner surface 111*b* of the conveyor belt 111. The belt roller 106 is a drive roller connected to a conveyor motor 174.

Two pairs of feed rollers 121*a* and 121*b*, and 122*a* and 122*b* are disposed between the conveyor unit 120 and the paper receiving unit 116. A printing paper P discharged from the conveyor unit 120 is, while being led by one shorter side thereof, sent upward in FIG. 1 by the feed rollers 121*a* and 121*b*. Then, the printing paper P is sent to the paper receiving unit 116 by the feed rollers 122*a* and 122*b*.

Figure 3:
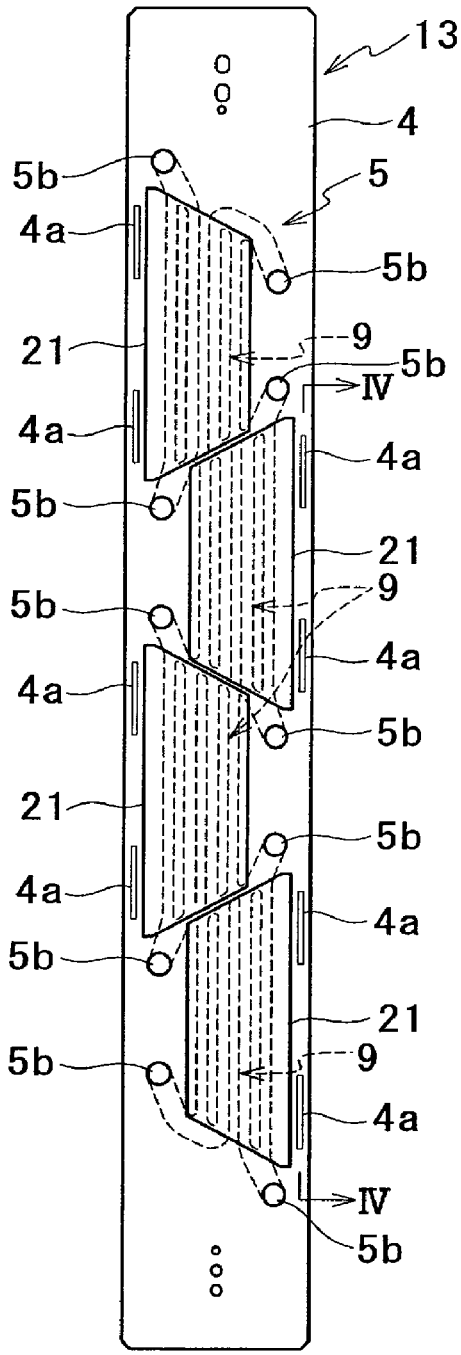
FIG. 3 is a plan view of a head main body shown in FIG. 2.
Figure 4:
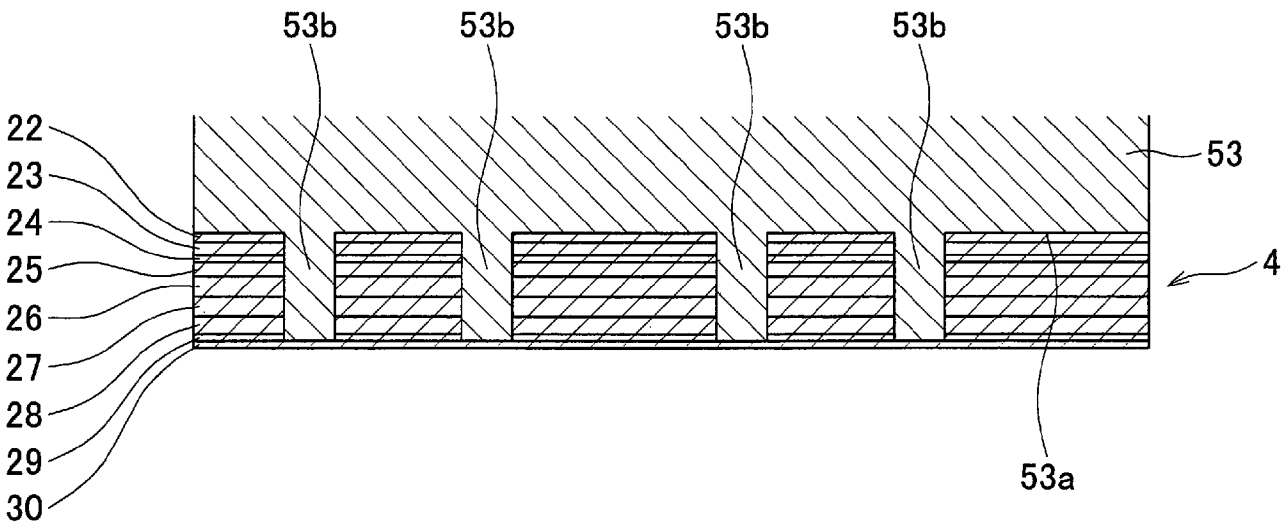
FIG. 4 is a sectional view as taken along line IV-IV in FIG. 3.
Figure 5:
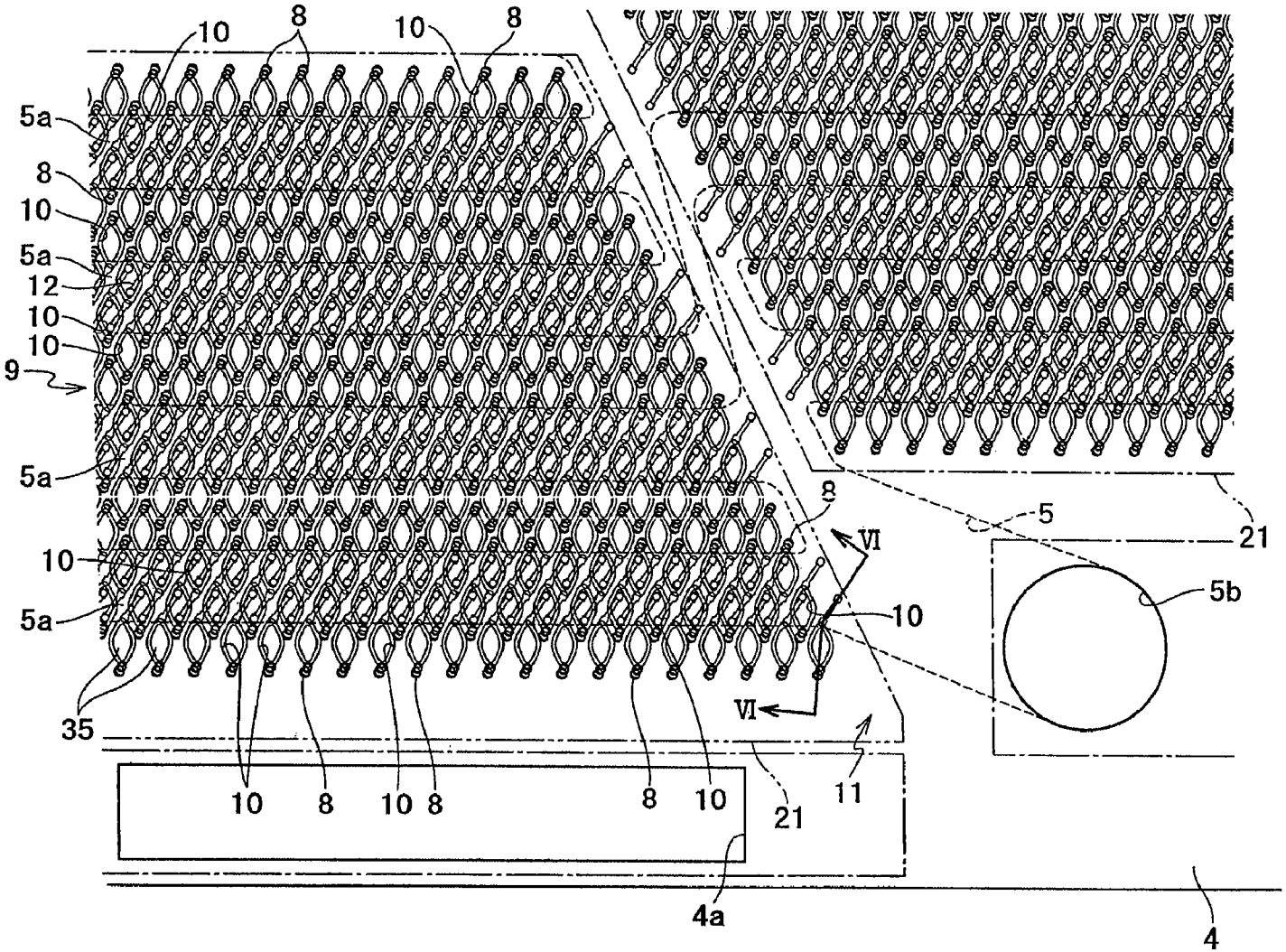
FIG. 5 is a partial enlarged view of FIG. 3.

Next, the ink-jet head 2 will be described in more detail with reference to FIGS. 2 to 7. In FIGS. 3 and 5, for the purpose of easy understanding, piezoelectric actuators 21 are illustrated with alternate long and two short dashes lines through they should be actually illustrated with solid lines, while pressure chambers 4 and apertures 12 are illustrated with solid lines though they locate under the piezoelectric actuators 21 and therefore should be actually illustrated with broken lines.

Figure 2:
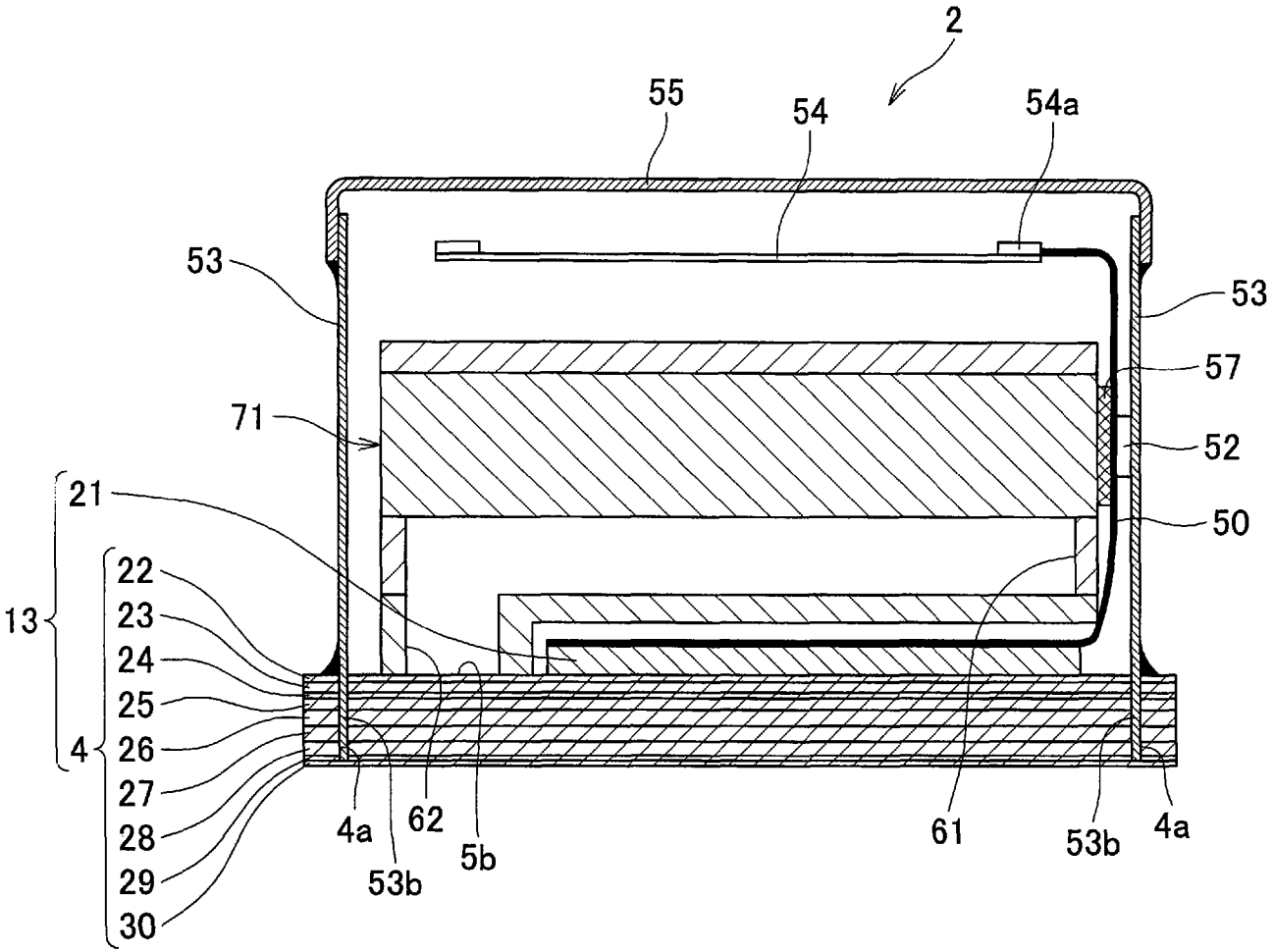
FIG. 2 illustrates a vertical section of an ink-jet head shown in FIG. 1, as sectioned along its widthwise direction.

As shown in FIG. 2, the ink-jet head 2 includes a reservoir unit 71, a head main body 13 which means a recording head, a COF (Chip On Film) 50, a circuit board 54, side covers 53, and a head cover 55. The head main body 13 is made up of a passage unit 4 and piezoelectric actuators 21.

The reservoir unit 71 is disposed on an upper face of the passage unit 4. An ink reservoir 61, which is a space for storing ink therein, is formed inside the reservoir unit 71. Ink stored in the ink reservoir 61 is supplied through holes 62 to the passage unit 4.

As shown in FIGS. 2 and 3, ten ink supply ports 5*b* are formed in the upper face of the passage unit 4.

Eight grooves 4*a* are formed in the upper face of the passage unit 4, near both end portions of the upper face. The eight grooves 4*a* form two rows which extend along a lengthwise direction of the passage unit 4.

The piezoelectric actuator 21 is fixed to the upper face of the passage unit 4 so as to be located within the gap formed between the passage unit 4 and the reservoir unit 71. The piezoelectric actuator 21 applies pressure to ink contained in pressure chambers 10 which are formed in the passage unit 4 (see FIG. 5), to thereby make ink ejected from ejection ports 8 which are formed at nozzle ends.

Figure 7:
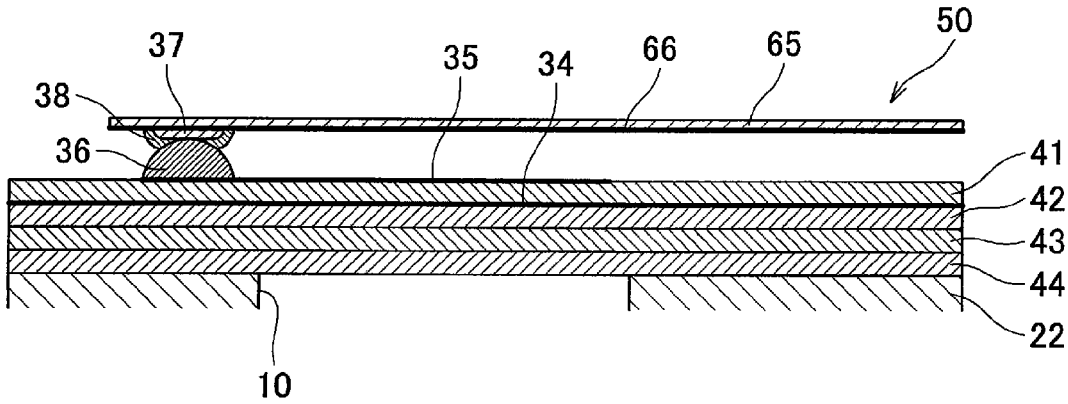
FIG. 7 is an enlarged view showing a vicinity of a piezoelectric actuator shown in FIG. 6.

The COF 50 is, near its one end, bonded to an upper face of the piezoelectric actuator 21. As shown in FIG. 7, a plurality of wires 66 are formed on a base member 65 of the COF 50. The wires 66 are electrically connected to respective individual electrodes 35 and a common electrode 34 which are formed on the piezoelectric actuator 21, as will be described later. A driver IC 52 is mounted on the base member 65. The driver IC 52 and the wires 66 are electrically connected to each other. The driver IC 52 controls potentials of the individual electrodes 35 and the common electrode 34. The COF 50 extends upward in a space between the side cover 53 and the reservoir unit 71. The other end of the COF 50 is connected to a connector 54*a* of the circuit board 54.

The side covers 53, which are made of a metal material, are substantially rectangular plates extending in a vertical direction and also in the lengthwise direction of the passage unit 4. As shown in FIG. 4, the side cover 53 has, at its lower end, a peripheral linear portion 53*a* and a plurality of protruding portions 53*b*. The peripheral linear portion 53*a* extends in parallel with the upper face of the passage unit 4, and is in close contact with the upper face of the passage unit 4. The protruding portions 53*b* are fitted in the plurality of grooves 4*a*, respectively. The side covers 53 extend over a substantially full length of the passage unit 4. In addition, the side covers 53 have their upper ends located higher than the reservoir unit 71 and the circuit board 54.

The head cover 55 is made of the same metal material as that of the side covers 53. The head cover 55 is disposed above the two side covers 53 so as to cover the two side covers 53. The reservoir unit 71, the COF 50, and the circuit board 54 are placed within a space enclosed by the two side covers 53 and the head cover 55.

Here, details of the head main body 13 will be described. As shown in FIG. 5, a plurality of pressure chambers 10 which constitute four pressure chamber groups 9 are formed in the passage unit 4. Each of the pressure chambers 10 serves as a part of an individual ink passage 32 (see FIG. 6). Ejection ports 8, which correspond to the respective pressure chambers 10, are also formed in the passage unit 4. Each ejection port 8 is provided at a distal end of each individual ink passage 32. Four piezoelectric actuators 21 of trapezoidal shape are bonded to the upper face of the passage unit 4. The four piezoelectric actuators 21 are arranged in two rows in a zigzag pattern. To be more specific, each piezoelectric actuator 21 is disposed with its parallel opposed sides, which mean upper and lower sides, extending along the lengthwise direction of the passage unit 4. In addition, oblique sides of every neighboring piezoelectric actuators 21 overlap each other with respect to the lengthwise direction of the passage unit 4.

Regions of a lower face of the passage unit 4 opposed to areas to which the respective piezoelectric actuators 21 are bonded serve as ink ejection regions 11. As shown in FIG. 5, a plurality of ejection ports 8 are regularly arranged in the ink ejection regions 11. On the upper face of the passage unit 4, a plurality of pressure chambers 10 are arranged in a matrix. On the upper face of the passage unit 4, such pressure chambers that exist within a region opposed to an area to which one piezoelectric actuator 21 is bonded constitute one pressure chamber groups 9. Each pressure chamber 10 is opposed to each one of individual electrodes 35 which are formed on the piezoelectric actuator 21, as will be described later.

Manifold channels 5 and sub manifold channels 5*a* are formed inside the passage unit 4. The manifold channels 5 act as a common ink chamber, and the sub manifold channels 5*a* are branch passages of the manifold channels 5. Ink is supplied through the supply ports 5*b* to the manifold channels 5 and then distributed to the respective sub manifold channels 5*a*.

Each of the ejection ports 8 communicates with a sub manifold channel 5*a* through a pressure chamber 10 having a substantially rhombic shape in a plan view and an aperture 12 acting as a throttle. Formed inside the passage unit 4 are a plurality of individual ink passages 32 each extending from an outlet of a sub manifold channel 5*a* through a pressure chamber 10 to a corresponding ejection port 8. Like the pressure chambers 10, the ejection ports 8 are arranged in a matrix. The plurality of ejection ports 8 formed in the passage unit 4 are arranged at regular intervals corresponding to 600 dpi with respect to the lengthwise direction of the passage unit 4.

Figure 6:
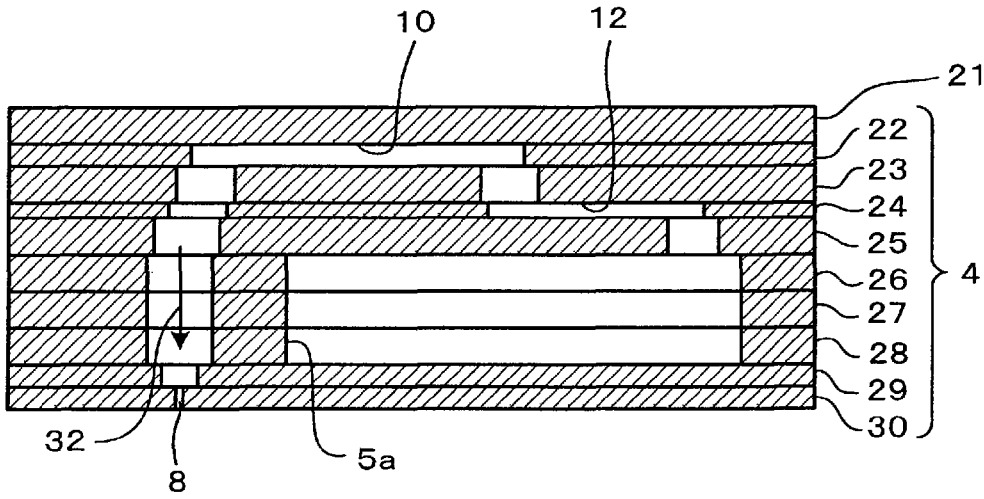
FIG. 6 is a sectional view as taken along line VI-VI in FIG. 5.

As shown in FIG. 6, the passage unit 4 has a layered structure of, from the top, a cavity plate 22, a base plate 23, an aperture plate 24, a supply plate 25, three manifold plates 26, 27, 28, a cover plate 29, and a nozzle plate 30, as mentioned above. The nine metal plates are positioned in layers so as to form individual ink passages 32.

As shown in FIG. 7, the piezoelectric actuator 21 is a layered structure of four piezoelectric layers 41, 42, 43, and 44, which are put on the cavity plate 22. Every one of the piezoelectric layers 41 to 44 has a thickness of approximately 15 μm, and thus the piezoelectric actuator 21 has a thickness of approximately 60 μm. Any of the piezoelectric layers 41 to 44 is a continuous laminar flat plate (continuous flat layer) so that it is disposed over the plurality of pressure chambers 10 formed within one ink ejection region 11. The respective piezoelectric layers 41 to 44 are made of a lead zirconate titanate (PZT)-base ceramic material having ferroelectricity.

An individual electrode 35 having a thickness of approximately 1 μm is formed on the piezoelectric layer 41. Both of the individual electrode 35 and a later-described common electrode 34 are made of a metallic conductive material such as Ag—Pd, Au, and the like. As shown in FIG. 5, the individual electrode 35 has a substantially rhombic shape in a plan view. The individual electrode 35 is formed so as to be opposed to a pressure chamber 10 with its large part falling within the pressure chamber 10 in a plan view. On the piezoelectric layer 41, substantially over a whole area thereof, a plurality of individual electrodes 35 are regularly arranged in two dimensions.

One acute portion of the individual electrode 35 extends out to a position above a pillar portion of the cavity plate 22 which means a portion of the cavity plate 22 where no pressure chamber 10 is formed. The pillar portion is bonded to the piezoelectric actuator 21, and supports the piezoelectric actuator 21. A land 36 is provided on a vicinity of an end of this extending-out portion. The land 36 has a substantially circular shape in a plan view, and has a thickness of approximately 15 μm. The land 36 is made of a conductive material similar to that of the individual electrode 35 and the common electrode 34. The individual electrode 35 and the land 36 are electrically connected to each other.

A common electrode 34 having a thickness of approximately 2 μm is interposed in a substantially entire region between the piezoelectric layer 41 and the piezoelectric layer 42. That is, the piezoelectric layer 41 is, in its portions opposed to the respective pressure chambers 10, sandwiched between the individual electrodes 35 and the common electrode 34.

Each of the plurality of individual electrodes 35 is electrically connected to the driver IC 52 through a wire 66 of the COF 50. Therefore, the driver IC 52 is able to individually control a potential of each individual electrode 35. The common electrode 34 is connected to the driver IC 52 through a wire 66 of the COF 50. The driver IC 52 maintains the common electrode 34 at the ground potential.

In the piezoelectric actuator 21, only the piezoelectric layer 41 among the four piezoelectric layers 41 to 44 is polarized in a direction oriented from the individual electrode 35 toward the common electrode 34. In order to drive the piezoelectric actuator 21 to eject ink from an ejection port 8, a potential of a drive signal which will be supplied to an individual electrode 35 for ink ejection is set to a drive potential V which is different from the ground potential. Consequently, a potential difference occurs in a region (i.e., an active region) sandwiched between the individual electrode 35 and the common electrode 34. An electric field in a thickness direction is thereby caused in this region of the piezoelectric layer 41 and, due to a transversal piezoelectric effect, this region of the piezoelectric layer 41 contracts in a horizontal direction which is perpendicular to the polarization direction. The other piezoelectric layers 42 to 44 do not contract by themselves, because no electric field is applied thereto. As a result, a portion of the piezoelectric layers 41 to 44 opposed to the individual electrode 35, as a whole, presents a unimorph deformation protruding toward a pressure chamber 10. A volume of the pressure chamber 10 is reduced accordingly, to raise ink pressure, so that ink is ejected from an ejection port 8. Then, when the individual electrode 35 returns to the ground potential, the piezoelectric layers 41 to 44 restore their original shape and thus the pressure chamber 10 restores its original volume. Consequently, ink is sucked from a sub manifold channel 5*a* into an individual ink passage 32. That is, the number of piezoelectric actuator elements included in one piezoelectric actuator 21 is equal to the number of individual electrodes 35.

As shown in FIGS. 2 and 7, the COF 50 is made up of a sheet-like base member 65 on which bumps 37, the driver IC 52, and wires 66 are placed. The bumps 37 are electrically bonded to the wires 66. The wires 66 are electrically connected to the driver IC 52, so that the driver IC 52 controls potentials of the individual electrodes 35 through the wires 66. The bumps 37 are provided near one end of the base member 65, and an arrangement pattern of the bumps 37 is the same as an arrangement pattern of the individual electrodes 35. A lower face of the bump 37 is covered with a solder 38. The land 36 and the bump 37 are electrically connected to each other, and at the same time the bump 37 is fixed to the land 36 by means of the solder 38.

Figure 8:
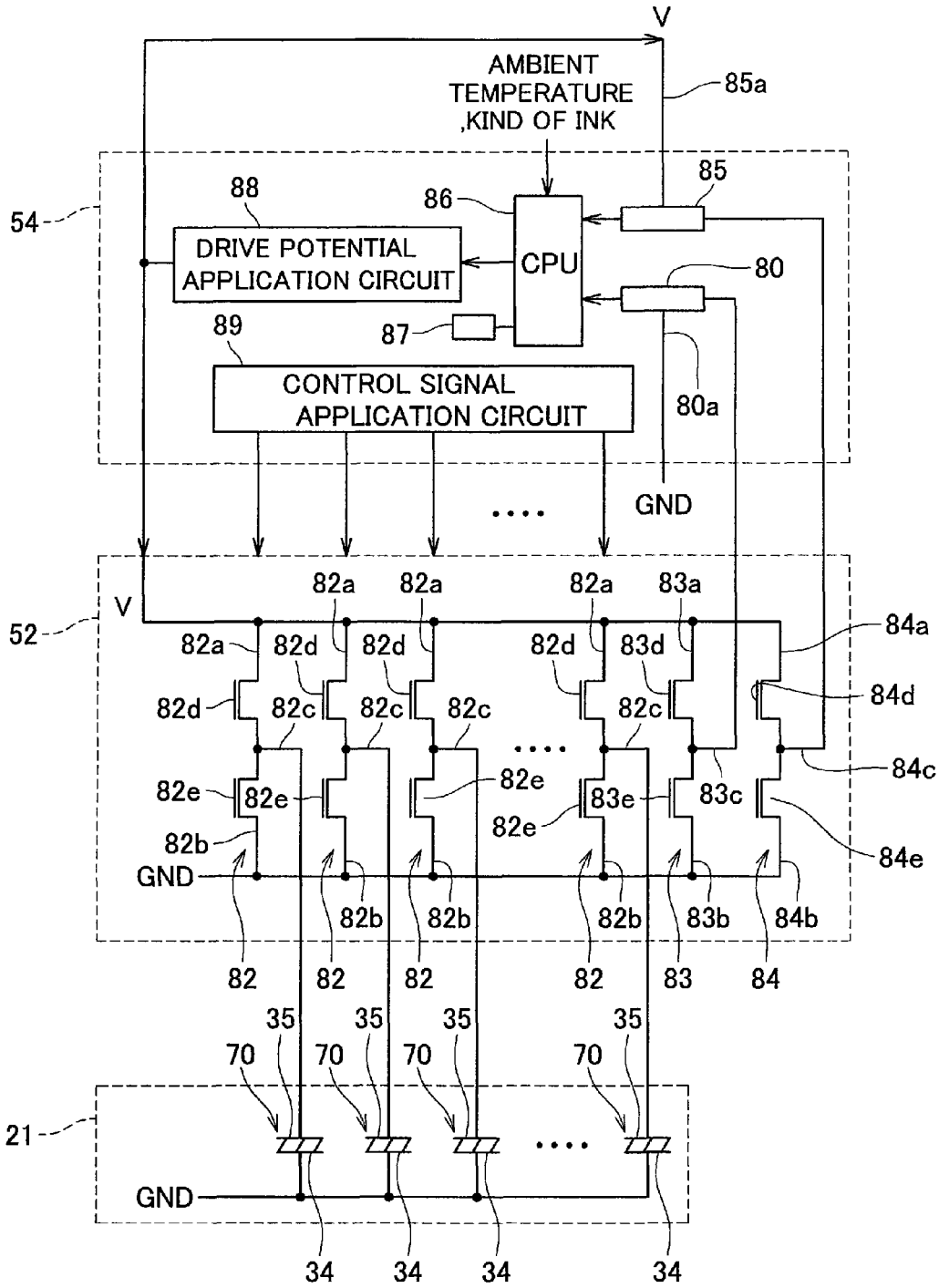
FIG. 8 is an equivalent circuit diagram of a piezoelectric actuator, a driver IC, and a circuit board shown in FIG. 2.

Next, a circuit configuration of the piezoelectric actuator 21, the driver IC 52, and the circuit board 54 will be described with reference to FIG. 8. As described above, the piezoelectric actuator 21 has such a construction that the piezoelectric layer 41 which is a dielectric is, in its portions corresponding to the respective pressure chambers 10, sandwiched between the individual electrodes 35 and the common electrode 34. Therefore, in an electrical sense, the piezoelectric actuator 21 is equivalent to a plurality of parallel-connected capacitors 70 as shown in FIG. 8.

The driver IC 52 includes a plurality of drive circuits 82 provided for the respective individual electrodes 35, and two dummy drive circuits 83 and 84. The drive circuit 82 has two series-connected switching elements 82*d* and 82*e*, a first terminal 82*a*, a second terminal 82*b*, and a third terminal 82*c*. The first terminal 82*a* is a terminal of the switching element 82*d*. The second terminal 82*b* is a terminal of the switching element 82*e*. The third terminal 82*c* is a terminal at which the two switching elements 82*d* and 82*e* are connected to each other. A plurality of first terminals 82*a* are connected to one another, and a drive potential V is applied to the plurality of first terminals 82*a* by a drive potential application circuit 88 which is provided in the circuit board 54. A plurality of second terminals 82*b* are connected to one another, and kept at the ground potential. A plurality of third terminals 82*c* are connected to corresponding individual electrodes 35, respectively, through the COF 50 and the lands 36 described above.

The switching element 82*d* is a transistor one example of which is an MOS-FET. In accordance with voltage applied to a gate terminal thereof, the switching element 82*d* switches a state of conduction between the first terminal 82*a* and the third terminal 82*c*. The switching element 82*e* is a transistor one example of which is an MOS-FET. In accordance with voltage applied to a gate terminal thereof, the switching element 82*e* switches a state of conduction between the second terminal 82*b* and the third terminal 82*c*. Hereinafter, a state where terminals of the switching elements 82*d* and 82*e* are connected will be referred to as an ON state, and a state where terminals of the switching elements 82*d* and 82*e* are not connected will be referred to as an OFF state.

Figure 10A:
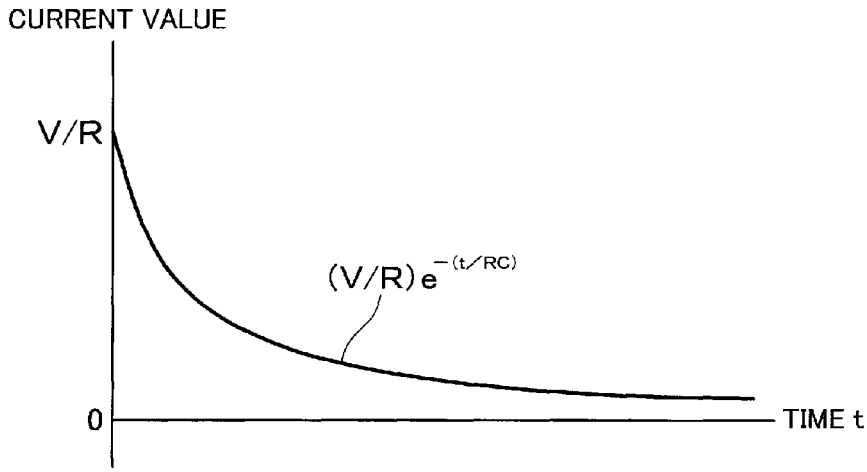
FIGS. 10A and 10B show how a current flowing through the drive circuit shown in FIG. 8 changes over time.
Figure 10B:
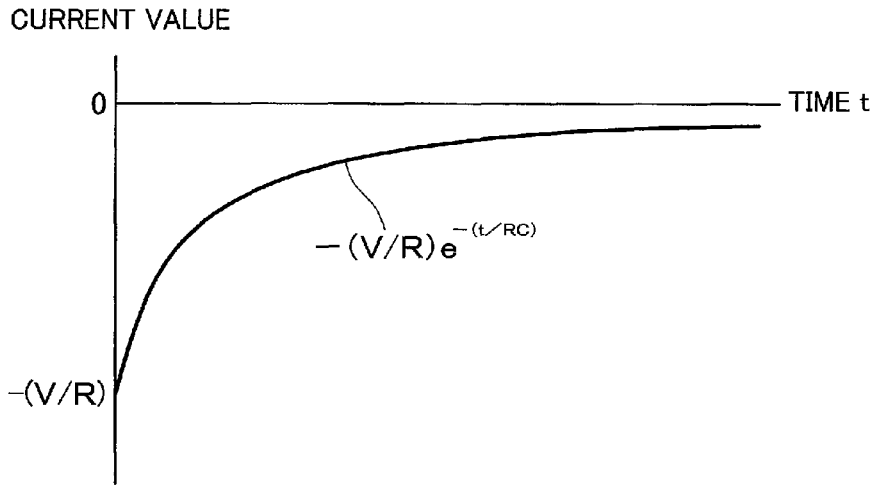

Each drive circuit 82 can selectively take either one of a charge state and a discharge state. In the charge state, due to a control signal applied from a control signal application circuit 89 of the circuit board 54 to a gate terminal, the switching element 82*d* is turned ON and the switching element 82*e* is turned OFF. In the discharge state, due to the control signal, the switching element 82*d* is turned OFF and the switching element 82*e* is turned ON. When the drive circuit 82 is switched from the discharge state to the charge state, a transient charging current flows to the capacitor 70 which is a recording element as shown in FIG. 10A, so that a potential of the individual electrode 35 rises up to the drive potential V. When the capacitor 70 is charged to its capacity and then the drive circuit 82 is switched from the charge state to the discharge state, a discharging current flows to the capacitor 70 as shown in FIG. 10B, so that the potential of the individual electrode 35 drops to the ground potential. Like this, by switching the plurality of drive circuits 82 between the charge state and the discharge state, drive signals are applied from the third terminals 82*c* to the individual electrodes 35.

The dummy drive circuit 83 has two switching elements 83*d* and 83*e*, a first terminal 83*a*, a second terminal 83*b*, and a third terminal 83*c*. The first terminal 83*a* is a terminal of the switching element 83*d*. The second terminal 83*b* is a terminal of the switching element 83*e*. The third terminal 83*c* is a terminal at which the two switching elements 83*d* and 83*e* are connected to each other. The first terminal 83*a* is connected to the plurality of first terminals 82*a*, and thus the drive potential V is applied to the first terminal 83*a*. The second terminal 83*b* is connected to the plurality of second terminals 82*b*, and thus kept at the ground potential. The third terminal 83*c* is connected to a current detection element 80 which is provided in the circuit board 54. In the dummy drive circuit 83 to which the control signal from the control signal application circuit 89 is not applied, the switching element 83*d* is always in the ON state while the switching element 83*e* is always in the OFF state. That is, the dummy drive circuit 83 is always in the charge state. Therefore, it is not necessary that the switching elements 83*d* and 83*e* are the same in construction as the switching elements 82*d* and 82*e* of the drive circuit 82.

The dummy drive circuit 84 has two switching elements 84*d* and 84*e*, a first terminal 84*a*, a second terminal 84*b*, and a third terminal 84*c*. The first terminal 84*a* is a terminal of the switching element 84*d*. The second terminal 84*b* is a terminal of the switching element 84*e*. The third terminal 84*c* is a terminal at which the two switching elements 84*d* and 84*e* are connected to each other. The first terminal 84*a* is connected to the plurality of first terminals 82*a*, and thus the drive potential V is applied to the first terminal 84*a*. The second terminal 84*b* is connected to the plurality of second terminals 82*b*, and thus kept at the ground potential. The third terminal 84*c* is connected to a current detection element 85 which is provided in the circuit board 54. In the dummy drive circuit 84 to which the control signal from the control signal application circuit 89 is not applied, the switching element 84*d* is always in the OFF state while the switching element 84*e* is always in the ON state. That is, the dummy drive circuit 84 is always in the discharge state. The dummy drive circuits 83 and 84 have the same electrical characteristics, including a resistance value, as those of the drive circuit 82.

The circuit board 54 is mounted with the drive potential application circuit 88, the control signal application circuit 89, a CPU (Central Processing Unit) 86, the two current detection elements 80 and 85 which function as a dummy signal detection means, and a memory 87.

Figure 9:
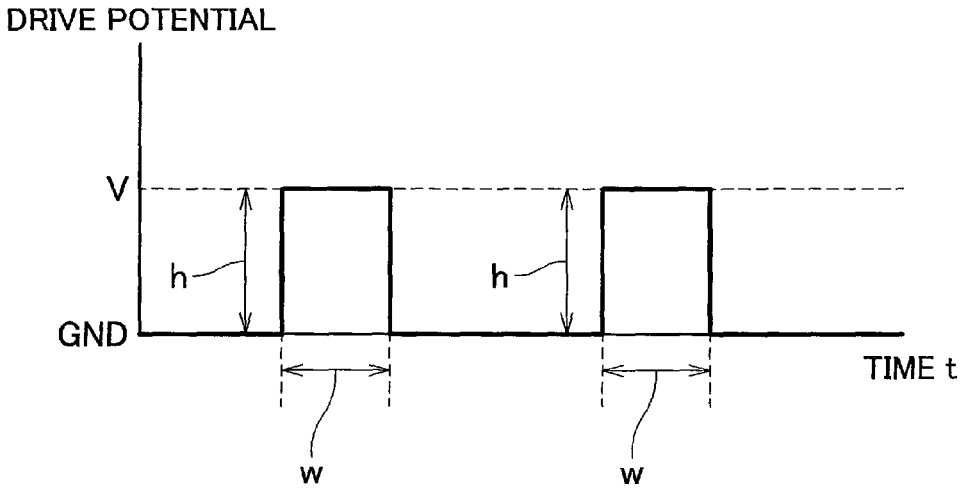
FIG. 9 shows a pulse-train voltage signal which is applied to a drive circuit shown in FIG. 8.

The drive potential application circuit 88 applies the drive potential V to the first terminals 82*a* of the plurality of drive circuits 82 and to a terminal 85*a* of the current detection element 85. The control signal application circuit 89 outputs a control signal, which is based on image data, to gate terminals of the switching elements 82*d* and 82*e*. A state of the switching elements 82*d* and 82*e* is accordingly switched between the ON state and the OFF state, so that the drive circuits 82 are brought into the charge state or the discharge state. To be more specific, a drive signal is applied to the gate terminals of the switching elements 82*d* and 82*e* such that a drive circuit 82 corresponding to an ejection port 8 which will be used for ink ejection is switched from the discharge state to the charge state and, after elapse of a predetermined period of time, switched from the charge state to the discharge state. That is, a pulse-train voltage signal as shown in FIG. 9, which functions as a drive signal, is applied to the individual electrode 35 which is connected to the drive circuit 82, and thus the piezoelectric actuator 21 is driven as described above.

The CPU 86 determines a value of the drive potential V which is applied by the drive potential application circuit 88 to the first terminal 82*a*. The CPU 86 also determines, based on image data, high-level periods of the control signal which is applied by the control signal application circuit 89 to the gate terminals of the respective switching elements 82*d* and 82*e*. In this embodiment, the drive potential application circuit 88, the control signal application circuit 89, and the CPU 86 constitute a drive signal control circuit. The CPU 86 is given data about an ambient temperature of the ink-jet head 2 and data about a kind of ink ejected from the ejection port 8. The data about an ambient temperature of the ink-jet head 2 are supplied from a temperature detection circuit (not shown) which is for example provided on the circuit board 54.

The current detection element 80 is connected to the third terminal 83*c* of the dummy drive circuit 83. The current detection element 80 has a terminal 80*a* which is kept at the ground potential. The current detection element 80 detects a current value of a dummy signal which flows from the third terminal 83*c* through the current detection element 80 to the terminal 80*a*. The current detection element 85 is connected to the third terminal 84*c* of the dummy drive circuit 84. The current detection element 85 has a terminal 85*a* to which the drive potential V is applied by the drive potential application circuit 88. The current detection element 85 detects a current value of a dummy signal which flows from the terminal 85*a* through the current detection element 85 to the third terminal 84*c*.

Stored in the memory 87 is a table which associates each of a plurality of operating environments with an initial value of a current which is supposed to flow through the drive circuit 82 when the charge state and the discharge state of the drive circuit 82 are switched from one to the other. The plurality of operating environments are defined by combinations of which temperature range (divided every predetermined temperature) an ambient temperature of the ink-jet head 2 belongs to and which kind of ink is ejected from the ejection port 8. For example, as the ambient temperature of the ink-jet head 2 is higher, an ink viscosity decreases, and moreover an ink viscosity differs depending on kind of ink ejected from the ejection port 8. Therefore, even though the same drive potential V is applied to the individual electrode 35, ink ejection characteristics, including a speed of ink ejection from the ejection port 8 and an ink ejection amount, change depending on an operating environment. In order to keep the ink ejection characteristics unchanged even while the operating environment changes, it is necessary that, at a higher ink viscosity, a larger drive potential V is applied to the individual electrode 35. Accordingly, in the memory 87, a larger current value is associated with an operating environment with a higher ink viscosity.

The CPU 86 extracts a current value associated with an actual operating environment from the current values associated with the respective operating environments in the table. The actual operating environment is defined by a combination of data about an ambient temperature of the ink-jet head 2 and data about a kind of ink ejected from the ejection port 8, which are given to the CPU 86. Then, the CPU 86 determines the extracted current value to be a reference current value. Then, based on the reference current value thus determined and a current value detected by the two current detection elements 80 and 85, the CPU 86 controls a value of the drive potential V which will be applied by the drive potential application circuit 88.

Here, a description will be given to how to determine a value of the drive potential V based on a reference current value and a current value detected by the current detection elements 80 and 85. The individual electrode 35, which is one of electrodes of the capacitor 70, is connected to the third terminal 82*c*. Therefore, a value of a current flowing through the drive circuit 82 (i.e., a value of a current flowing through the third terminal 82*c*) after the drive circuit 82 is switched from the discharge state to the charge state is approximately $(V/R)*e^{-(t/RC)}$ at a time point t which represents a time elapsed from switching, as shown in FIG. 10A. Here, a character R represents an internal resistance of the drive circuit 82, and a character C represents a capacitance of the capacitor 70. On the other hand, a value of a current flowing through the drive circuit 82 after the drive circuit 82 is switched from the charge state to the discharge state is approximately $-(V/R)*e^{-(t/RC)}$ at a time point t which represents a time elapsed from switching, as shown in FIG. 10B. A positive direction of the current values represented by these formulas is a direction oriented from the third terminal 82*c* to the individual electrode 35.

The dummy drive circuits 83 and 84 have the same electrical characteristics as those of the drive circuit 82, and are not connected to the capacitor 70. Therefore, a current value of a dummy signal detected by the current detection element 80 is V/R, and a current value detected by the current detection element 85 is −(V/R). A positive direction of the current values represented by these formulas is a direction oriented from the third terminals 83*c* and 84*c* to the current detection elements 80 and 85, respectively. Accordingly, a current value of a dummy signal detected by the current detection element 80 is substantially identical to an initial value of a current which flows through the drive circuit 82 when the drive circuit 82 is switched from the discharge state to the charge state. A current value of a dummy signal detected by the current detection element 85 is substantially identical to an initial value of a current which flows through the drive circuit 82 when the drive circuit 82 is switched from the charge state to the discharge state.

When the piezoelectric actuator 21 is driven and thereby a temperature of the driver IC 52 rises, electrical characteristics of the drive circuit 82 including a value of an internal resistance R are changed. Thus, a value of a current flowing through the drive circuit 82 is also changed. Change in value of a current flowing through the drive circuit 82 causes change in ink ejection characteristics including a speed of ink ejection from the ejection port 8 and an ink ejection amount.

Electrical characteristics, including a value of an internal resistance R, of the dummy drive circuits 83 and 84 are also changed in accordance with change in temperature of the driver IC 52. The CPU 86 compares a current value of a dummy signal detected by the current detection elements 80 and 85 with a reference current value determined by the CPU 86. When the current value of the dummy signal detected by the current detection elements 80 and 85 is smaller than the reference current value, the CPU 86 increases a value of the drive potential V which is applied by the drive potential application circuit 88 to the first terminal 82*a*. That is, the CPU 86 increases a pulse height h of the pulse-train voltage signal shown in FIG. 9. As a result, a current having a larger current value flows through the drive circuit 82 and the dummy drive circuits 83 and 84, so that the current value of the dummy signal detected by the current detection elements 80 and 85 approaches the reference current value.

When the current value of the dummy signal detected by the current detection elements 80 and 85 is larger than the reference current value, the CPU 86 reduces a value of the drive potential V which is applied by the drive potential application circuit 88 to the first terminal 82*a*. That is, the CPU 86 reduces a pulse height h of the pulse-train voltage signal shown in FIG. 9. As a result, a current having a smaller current value flows through the drive circuit 82 and the dummy drive circuits 83 and 84, so that the current value of the dummy signal detected by the current detection elements 80 and 85 approaches the reference current value. As described above, the drive potential V is controlled based on a current value of the dummy signal which takes account of change in electrical characteristics of the drive circuit 82 involved in change in temperature of the driver IC 52. Therefore, even if electrical characteristics of the drive circuit are changed by change in temperature of the driver IC 52, characteristics of ink ejection from the ejection port 8 can be stabilized.

By performing the above-described controlling of the drive signal in each of the four piezoelectric actuators 21 of the ink-jet head 2, characteristics of ink ejection from every ejection port 8 of the ink-jet head 2 can be stabilized. Further, the drive signal is controlled in the above-described manner in each of the four ink-jet heads 2 shown in FIG. 1. As a result, the four ink-jet heads 2 present substantially the same ink ejection characteristics. Since the drive signal is controlled in the respective ink-jet heads 2 like this, variation in ink ejection characteristics among the four ink-jet heads 2 can be prevented.

In this embodiment, since the dummy drive circuits 83 and 84 have the same electrical characteristics as those of the drive circuit 82, an initial value of a current which flows through the drive circuit 82 is identical to a value of the dummy current. This makes controlling easy.

In this embodiment, the current detection elements 80 and 85 detect a current value of a dummy signal which flows through the third terminal 83*c* and 84*c* of the dummy drive circuits 83 and 84. The current value is compared with a reference current value which is determined by the CPU 86. Depending on a comparison result, a value of the drive potential V, that is, a pulse height h of the pulse-train voltage signal which is a drive signal applied to the individual electrode is changed. Therefore, ink ejection characteristics can be stabilized even if electrical characteristics of the drive circuit 82 are changed because of change in temperature of the driver IC 52.

At this time, the dummy drive circuit 83 and the dummy drive circuit 84 are in the charge state and the discharge state, respectively, and current values of dummy signals which flow through the respective third terminals 83*c* and 84*c* are detected by the current detection elements 80 and 85, respectively. Accordingly, it is possible to control the drive potential V in accordance with a value of a current which flows through the drive circuit 82 at both timings when the drive circuit 82 is switched from the charge state to the discharge state and when the drive circuit 82 is switched from the discharge state to the charge state. Consequently, ink ejection characteristics can more surely be stabilized.

Stored in the memory 87 is the table which associates each of a plurality of operating environments with an initial value of a current which is supposed to flow through the drive circuit 82 when the charge state and the discharge state of the drive circuit 82 are switched from one to the other. This enables the CPU 86 to determine a reference current value to be a current value suitable for an actual operating environment. As a result, ink ejection characteristics can be stabilized irrespective of an operating environment.

In addition, since the ink-jet head 2 adopts the piezoelectric actuator 21, a current value detected by the current detection elements 80 and 85 is identical to initial values of currents which flow through the third terminal 82*c* at a time when the drive circuit 82 is switched between the charge state and the discharge state. Therefore, a current which flows through the third terminal 82*c* of the drive circuit 82 can be easily controlled by determining a reference current value to be a value supposed to be the initial value.

Further, since the drive potential V is controlled in each of the four ink-jet heads 2, occurrence of variation in ink ejection characteristics among the four ink-jet heads 2 can be prevented.

Next, various modifications of the above-described embodiment will be described. Here, the same members as those of the above-described embodiment will be denoted by the same reference numerals, without a specific description thereof.

Figure 11:
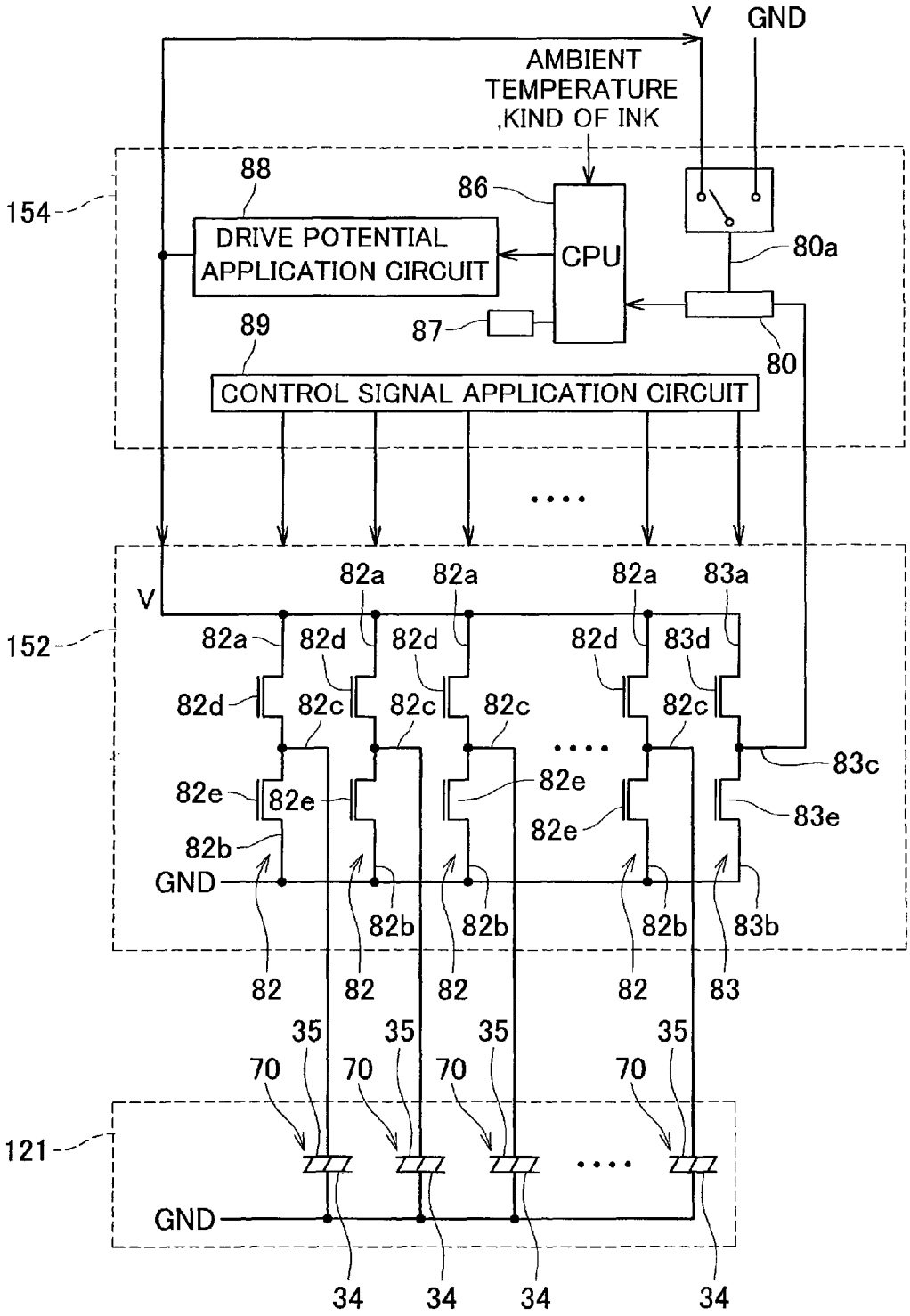
FIG. 11 is a counterpart of FIG. 8, showing a first modification.

In a first modification shown in FIG. 11, a driver IC 152 includes only one dummy drive circuit 183 having three terminals 183*a*, 183*b*, and 183*c*. A circuit board 154 includes only a single current detection element 80 which is connected to the third terminal 183*c* of the dummy drive circuit 183. The dummy drive circuit 183 is switched between the charge state and the discharge state at predetermined time intervals by means of a control signal which is applied by the control signal application circuit 89 to gate terminals of switching elements 183*d* and 183*e*. The switching elements 183*d* and 183*e* are the same in construction as the switching elements 82*d* and 82*e* of the drive circuit 82. A potential applied to the terminal 80*a* of the current detection element 80 is switched by a switch 101 between a drive potential V and the ground potential at predetermined time intervals. The switch 101 switches a potential applied to the terminal 80*a* in such a manner that the terminal 80*a* is kept at the ground potential while the dummy drive circuit 83 is in the charge state whereas the drive potential V is applied to the terminal 80*a* while the dummy drive circuit 83 is in the discharge state.

In such a case as well, like in the above-described embodiment, the CPU 86 controls the drive potential V based on a comparison between a current value of a dummy signal detected by the current detection element 80 and a reference current value determined by the CPU 86. As a result, ink ejection characteristics can be stabilized even if electrical characteristics of the drive circuit 82 are changed along with change in temperature of the driver IC 52. In addition, the single dummy drive circuit 83 and the single current detection element 80 are respectively switched at predetermined time intervals. Therefore, constructions of the driver IC 152 and the circuit board 154 can be simplified.

Figure 12:
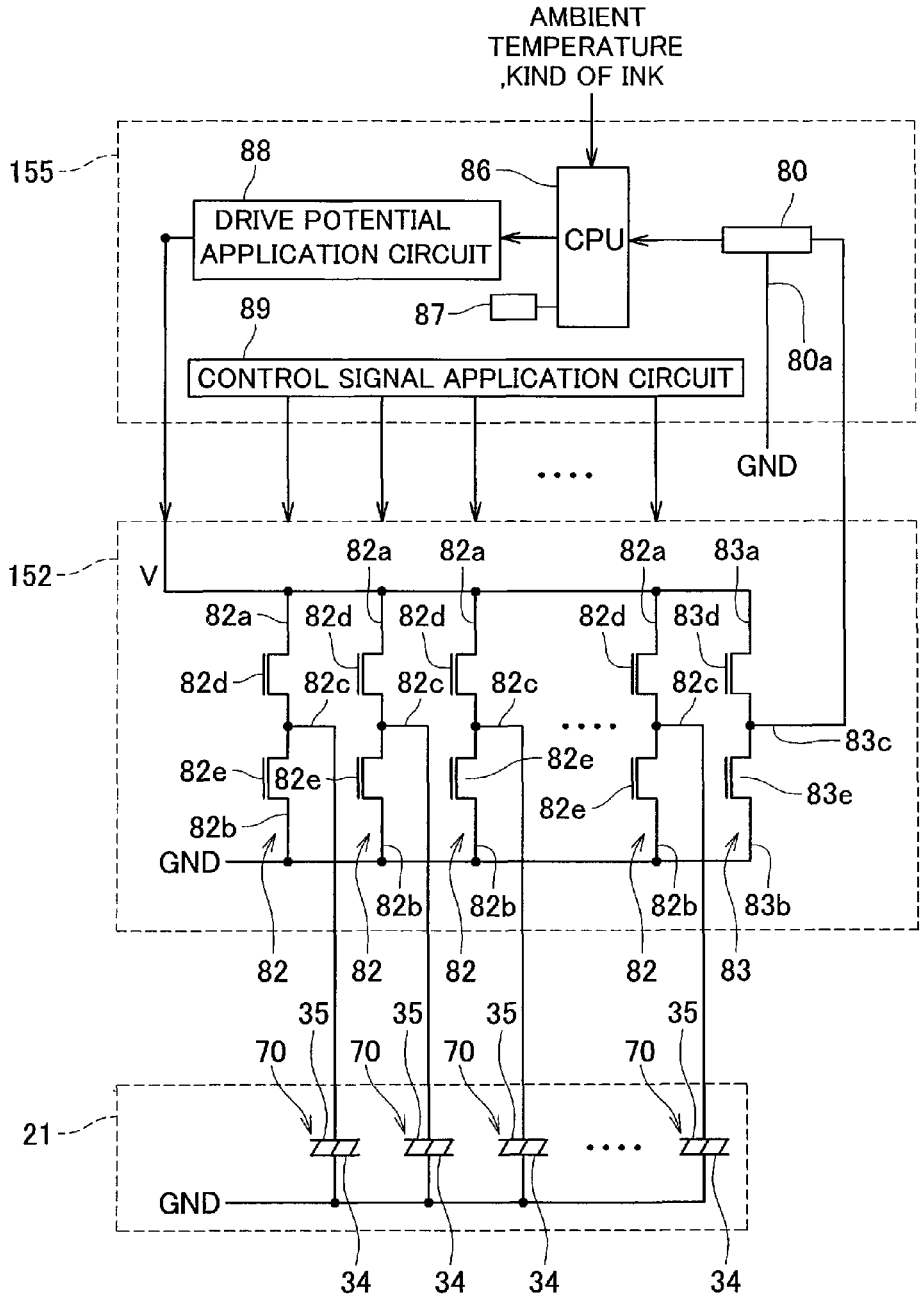
FIG. 12 is a counterpart of FIG. 8, showing a second modification.

In a second modification shown in FIG. 12, a driver IC 152 includes only one dummy drive circuit 83. A circuit board 155 includes only a single current detection element 80 which is connected to the third terminal 83*c* of the dummy drive circuit 83. The dummy drive circuit 83 is always in the charge state, and a terminal 80*a* of the current detection element 80 is always kept at the ground potential.

At a time point t which represents a time elapsed from when the drive circuit 82 having the third terminal 82*c* which is connected to the individual electrode 35 is switched from the discharge state to the charge state, a value of a current flowing through the drive circuit 82 is $(V/R)e^{-(t/RC)}$. At a time point t which represents a time elapsed from when the drive circuit 82 is switched from the charge state to the discharge state, a value of a current flowing through the drive circuit 82 is $-(V/R)e^{-(t/RC)}$. Since the both currents have the same absolute value like this, controlling of one of them involves controlling of the other of them. Accordingly, even if a temperature of the driver IC 152 changes, ink ejection characteristics can be stabilized by bringing the dummy drive circuit 83 into the charge state, then detecting a current value of a dummy signal which flows from the third terminal 83*c* to the terminal 80*a*, and comparing the detected value with a reference current value to thereby control a drive potential V. In addition, since the single dummy drive circuit 83 and the single current detection element 80 are satisfying, constructions of the driver IC 152 and the circuit board 155 are simplified. Moreover, unlike in the first modification, it is not necessary to switch a potential applied to the terminal 80*a* of the current detection element 80 by means of a switch, the construction of the circuit board 155 can be more simplified.

In the second modification, the dummy drive circuit 83 is always in the charge state, and the terminal 80*a* of the current detection element 80 is kept at the ground potential. However, it may also be possible to perform the same controlling in a condition that the dummy drive circuit 83 is always in the discharge state and the drive potential V is applied to the terminal 80*a* of the current detection element 80.

As a third modification, it may be possible that, when an absolute value of a current which flows through the dummy drive circuits 83 and 84 is larger than the reference current value, the control signal application circuit 89 changes a timing of switching the drive circuit 82 between the charge state and the discharge state in such a manner that a pulse width w of a pulse-train signal (see FIG. 9) becomes shorter as a difference between the absolute value and the reference current value is larger. Thus, in a case where a large initial current flows through the drive circuit 82, the pulse width w of the pulse signal is shortened. Consequently, the piezoelectric layer 41 recovers from deformation before the deformation reaches completion. Therefore, an amount of ink ejected from the ejection port 8 is reduced, so that ink ejection characteristics of the ink-jet head 2 can be stabilized.

In the above-described embodiment, the piezoelectric actuator 21 applies pressure to ink contained in the pressure chamber 10, and thereby ink is ejected from the ejection port 8. However, this is not limitative. The present invention may be applicable to other printing apparatuses including a thermal head with a plurality of heating elements which performs recording by applying heat to a thermosensitive paper or an ink ribbon. For a printer including a thermal head, such an electrical construction that the capacitor 70 is replaced with a resistance in FIG. 8 is adopted. Thus, resistances having the same resistance value as a resistance value of this replacing resistance are connected between the dummy drive circuits 83, 84 and the current detection elements 80, 85. Values of currents which flow through the current detection elements 80 and 85 are detected. At this time, a current value of a dummy signal detected by the current detection elements 80 and 85 is identical to a value of a current which flows from the drive circuit 82 to the heating element. Therefore, recording characteristics can be stabilized also in the thermal head, by controlling a drive potential V based on a comparison between the current value detected by the current detection elements 80, 85 and a reference current value.

The respective examples given above are examples of applying the present invention for the purpose of controlling a drive potential V in performing printing. However, the present invention may be applied for other purposes. Here, one of the purposes will be described by taking the driver IC 52 shown in FIG. 8 as an example. In manufacturing the printing apparatus, the ground potential is applied to the third terminal 83*c* of the driver IC 52 and a drive potential V is applied to the third terminal 84*c*. Then, the drive potential V is applied to the first terminals 83*a* and 84*a* of the dummy drive circuits 83 and 84 of the driver IC 52, which are not connected to another member. Thus, a current value of a dummy signal which flows through the third terminals 83*c* and 84*c* is detected. The current value of the dummy signal thus detected indicates electrical characteristics of a drive circuit which is included in the driver IC 52.

Like this, since the driver IC 52 has the dummy drive circuits 83 and 84, electrical characteristics of a drive circuit included in the driver IC 52 can be easily checked without mounting the driver IC 52 to a printing apparatus. Therefore, in a case where a single printing apparatus includes a plurality of driver ICs, it may be possible to extract and use, among many driver ICs whose drive circuits have been in advance examined for electrical characteristics, a plurality of driver ICs whose drive circuits have close or the same electrical characteristics. This makes it unnecessary to change a form of a drive signal supplied to a driver IC depending on which driver IC the drive signal will be supplied. Therefore, a circuit configuration of a printing apparatus can be simplified. Besides, since a dummy drive circuit is always kept in either one of the charge state and the discharge state, it is not necessary to apply a control signal to the dummy drive circuit to bring it into the charge or discharge state. The driver IC 152 shown in FIG. 12 can be applied for this purpose.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A printing apparatus comprising:

a recording head including a recording element which performs recording on a recording medium and ejecting liquid, wherein the recording head comprises:

a passage unit formed with an individual liquid passage having a pressure chamber and an ejection port which ejects liquid; and a piezoelectric actuator element which applies pressure to liquid contained in the pressure chamber;

a driver IC including a drive circuit which applies a drive signal to the recording element, and a dummy drive circuit which outputs a dummy signal having a value associated with the drive signal;

a dummy signal detection circuit which detects a current value of the dummy signal;

a reference current value determiner which determines a reference current value, associated with a value of a current which is supposed to flow through the drive circuit, to be a value adapted for an actual operating environment of the printing apparatus, the actual operating environment being defined by a combination of an ambient temperature of the printing apparatus and the kind of liquid ejected from the recording head; and a drive signal control circuit which controls the drive signal based on a current value of the dummy signal detected by the dummy signal detection circuit and the reference current value, wherein the drive signal control circuit comprises a drive potential applicator which applies a drive potential to the drive circuit and the dummy drive circuit, wherein each of the drive circuit and the dummy drive circuit comprises a first terminal to which the drive potential applicator applies the drive potential, a second terminal which is kept at a predetermined potential different from the drive potential, and a third terminal, wherein the drive circuit is able to selectively take either one of a charge state where the third terminal is connected to the first terminal but not connected to the second terminal and a discharge state where the third terminal is connected to the second terminal but not connected to the first terminal, wherein the third terminal of the drive circuit is connected to the piezoelectric actuator element, and the third terminal of the dummy drive circuit is connected to the dummy signal detection circuit, and wherein a current value of a dummy signal outputted from the dummy drive circuit is identical to either one of an initial value of a current which flows through the drive circuit at a time when a state of the drive circuit is switched from the charge state to the discharge state and an initial value of a current which flows through the drive circuit at a time when a state of the drive circuit is switched from the discharge state to the charge state.

2. The printing apparatus according to claim 1, wherein electrical characteristics of the dummy drive circuit are substantially the same as those of the drive circuit.

3. The printing apparatus according to claim 1, wherein the reference current value determiner includes a memory which stores therein a table which associates each of a plurality of operating environments of the printing apparatus with a current value, and the reference current value determiner determines the reference current value to be a current value associated in the table with an actual operating environment.

4. The printing apparatus according to claim 1, wherein:

the drive signal is a pulse-train signal including a plurality of pulses; and the drive signal control circuit increases a height of the pulse when an absolute value of a current of the dummy signal is smaller than the reference current value, and reduces a height of the pulse when an absolute value of a current of the dummy signal is larger than the reference current value.

5. The printing apparatus according to claim 1, wherein:

the drive signal is a pulse-train signal including a plurality of pulses; and when an absolute value of a current of the dummy signal is larger than the reference current value, the drive signal control circuit makes a width of the pulse narrower for a larger difference between a current value of the dummy signal and the reference current value.

6. The printing apparatus according to claim 1, wherein:

the printing apparatus includes a plurality of the driver ICs; and the reference current value determiner determines the reference current value for each of the plurality of driver ICs.

7. The printing apparatus according to claim 1, wherein the dummy drive circuit included in the driver IC has two dummy drive circuits one of which is always in the charge state and the other of which is always in the discharge state.

8. The printing apparatus according to claim 1, wherein the dummy drive circuit included in the driver IC has one dummy drive circuit a state of which is switched between the charge state and the discharge state at predetermined time intervals.

9. The printing apparatus according to claim 1, wherein the dummy drive circuit included in the driver IC has one dummy drive circuit which is always kept in either one of the charge state and the discharge state.

10. The printing apparatus according to claim 1, wherein the drive circuit is made up of two series-connected switching elements.

* * * * *